US011465822B2

(12) United States Patent
Weiner et al.

(10) Patent No.: US 11,465,822 B2
(45) Date of Patent: Oct. 11, 2022

(54) CONTAINER FOR STORING AND MIXING FOOD ITEMS

(71) Applicant: ESSENDUB, LLC, Old Town, FL (US)

(72) Inventors: Fernando Osegueda Weiner, Colorado Springs, CO (US); Benjamin Caleb Smith, Old Town, FL (US)

(73) Assignee: ESSENDUB, LLC, Old Town, FL (US)

( * ) Notice: Subject to any disclaimer, the term of this patent is extended or adjusted under 35 U.S.C. 154(b) by 48 days.

(21) Appl. No.: 16/943,791

(22) Filed: Jul. 30, 2020

(65) Prior Publication Data

US 2021/0032005 A1 Feb. 4, 2021

Related U.S. Application Data

(60) Provisional application No. 62/880,781, filed on Jul. 31, 2019.

(51) Int. Cl.

| | |
|---|---|
| ***B65D 81/32*** | (2006.01) |
| ***B65D 51/24*** | (2006.01) |
| ***A47G 19/06*** | (2006.01) |

(52) U.S. Cl.

CPC ..... *B65D 81/3211* (2013.01); *A47G 19/06* (2013.01); *B65D 51/246* (2013.01); *A47G 2400/062* (2013.01); *B65D 2217/04* (2013.01)

(58) Field of Classification Search

CPC .. B65D 81/3211; B65D 51/246; A47G 19/06; A47G 2400/062

USPC ..... 206/221, 219

See application file for complete search history.

(56) References Cited

U.S. PATENT DOCUMENTS

| | | | |
|---|---|---|---|
| 5,676,244 | A | 10/1997 | Green et al. |
| 5,727,679 | A | 3/1998 | Newarski |
| 6,196,406 | B1 | 3/2001 | Ennis |
| 7,147,880 | B2 | 12/2006 | Lenahan |

(Continued)

FOREIGN PATENT DOCUMENTS

| | | | | |
|---|---|---|---|---|
| EP | 0856475 | A1 * | 8/1998 | ..... B65D 47/26 |
| GB | 2 134 873 | A | 8/1984 | |

(Continued)

OTHER PUBLICATIONS

The International Search Report of International Application No. PCT/US2020/044298 dated Oct. 15, 2020.

*Primary Examiner* — Steven A. Reynolds

(74) *Attorney, Agent, or Firm* — Cowan, Liebowitz & Latman, P.C.; Mark Montague; Brian S. Matross

(57) ABSTRACT

A portable container includes a top portion defining a first hollow region configured to store a first product, a bottom portion rotatably coupled to the top portion and defining a second hollow region configured to store a second product, and a sealing mechanism configured to selectively fluidly couple the first and second hollow regions during relative rotation of the top and bottom portions. The sealing mechanism is movable between a closed position in which the first hollow region of the top portion is fluidly isolated from the hollow region of the bottom portion, and an open position in which the first hollow region is fluidly coupled with the second hollow region. Rapid relative rotation of the top and bottom portions causes the sealing mechanism to move from the closed position to the open position.

11 Claims, 11 Drawing Sheets

(56) References Cited

U.S. PATENT DOCUMENTS

| | | | | |
|---|---|---|---|---|
| 8,485,378 | B2 * | 7/2013 | Zoss | A47G 19/02 215/DIG. 8 |
| 8,496,983 | B2 | 7/2013 | Michaeli et al. | |
| 8,651,279 | B2 | 2/2014 | Malone et al. | |
| 2008/0164253 | A1 | 7/2008 | Truong | |
| 2013/0037506 | A1 * | 2/2013 | Wahlstrom | A61J 1/2093 215/6 |
| 2019/0009969 | A1 | 1/2019 | Kite | |

FOREIGN PATENT DOCUMENTS

| | | | |
|---|---|---|---|
| KR | 20070087473 | A | 8/2007 |
| WO | 2012/075105 | A1 | 6/2012 |
| WO | 2015/120468 | A2 | 8/2015 |

* cited by examiner

Fig. 11
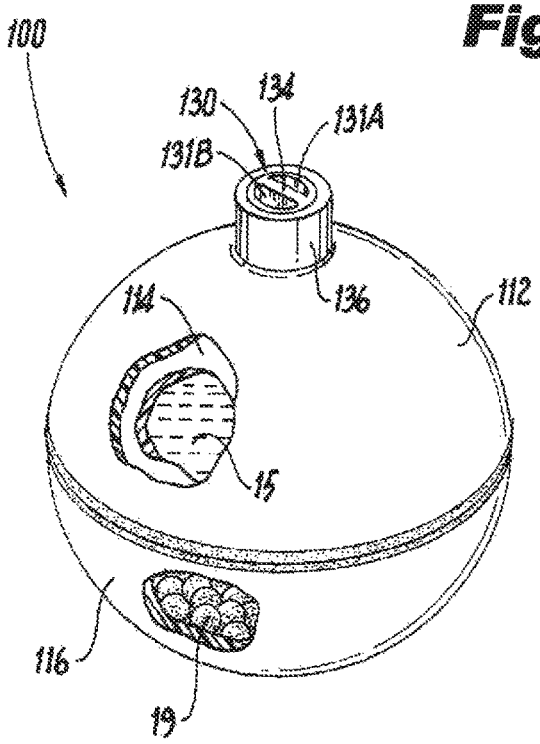
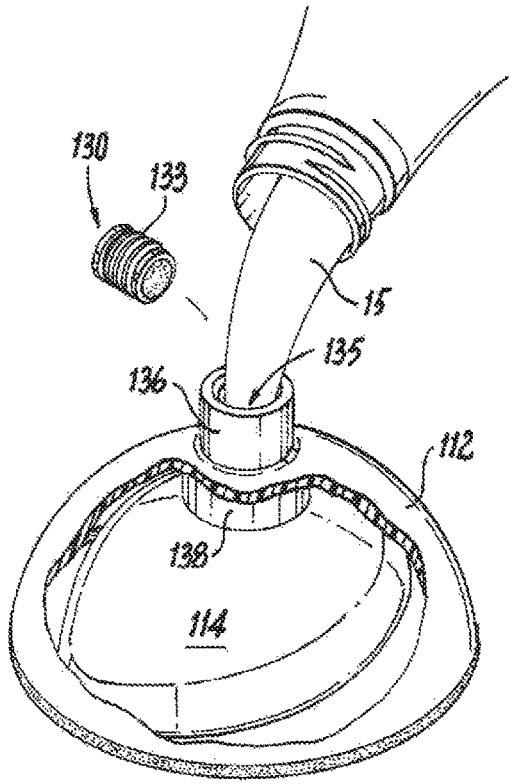
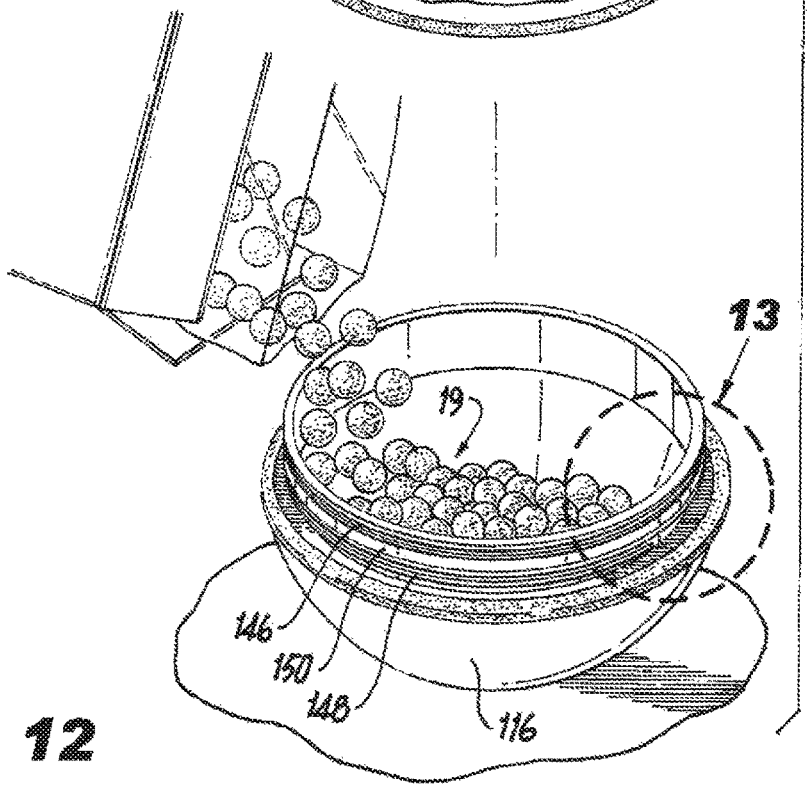
Fig. 12

Fig. 17
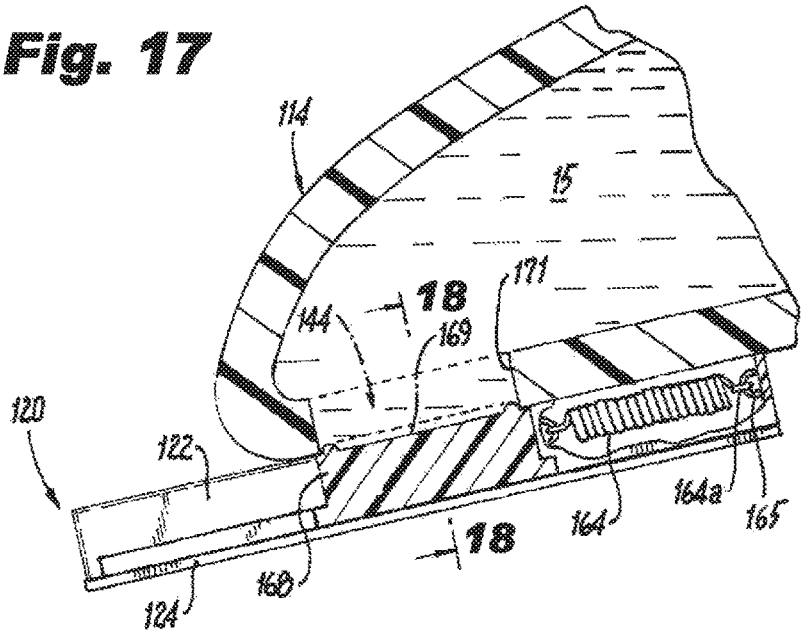
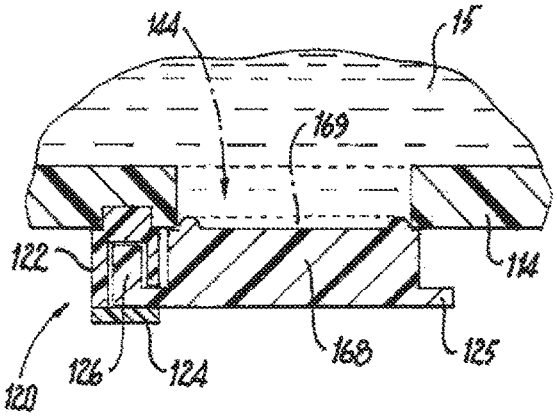
Fig. 18
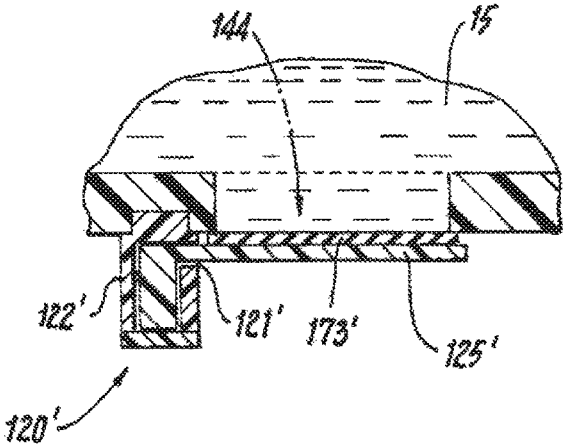
Fig. 19

CONTAINER FOR STORING AND MIXING FOOD ITEMS

REFERENCE TO RELATED APPLICATIONS

The present application claims priority to U.S. Provisional Patent Application No. 62/880,781, filed Jul. 31, 2019 and titled CONTAINER FOR STORING AND MIXING FOOD ITEMS, which is hereby incorporated by reference herein in its entirety.

BACKGROUND OF THE INVENTION

1. Field of the Invention

The present invention relates to portable storage containers with separate compartments, and more particularly, to portable food storage containers for storing, separating, and mixing food items.

2. Description of the Related Art

Breakfast cereal is typically prepared by placing cereal into a bowl and adding milk. A young child who prepares breakfast cereal at home or school may inadvertently spill the milk and/or cereal, which requires cleanup time and may ruin the child's breakfast. Additionally, adults who are in a rush to get to work may spill milk or cereal when preparing it for themselves or their children. Similarly, an adult who prepares and packs a lunch for his or her child may desire that his or her child eat a nutritious salad, and may wish to provide a dressing with the salad, such as an oil/vinegar mixture. Salad dressing, which is typically stored in a separate container, can similarly create spillage issues when dispensed by a child.

Cereal-milk and salad-dressing mixtures cannot be prepared too far in advance without sacrificing quality. For example, if milk is added to cereal the night before and left in the refrigerator, the cereal becomes soggy and undesirable. Similarly, if dressing is added to a salad too far in advance, the salad also becomes soggy and undesirable.

It would be advantageous if the preparations for and the creation of cereal-milk, salad-dressing, and other food mixtures could be set up in advance in a refrigerated portable container which separates these food items. It would also be advantageous if such a portable container were easily accessible, transportable, and operable by a child to create the food mixture from the components thereof at an appropriate time while preventing spillage.

OBJECTS AND SUMMARY OF THE INVENTION

This summary is not intended to identify or point to essential features or limit the scope of the subject matter claimed herein. The present invention relates to a portable storage container and method which utilizes a rotatable lid and a sealing/release mechanism to fluidly isolate and selectively fluidly couple food items stored within the container, with at least the following objectives:

To store food items associated with a food mixture in a single container with separate compartments, and enable easy mixing thereof without spillage;

To provide a sealing mechanism which fluidly isolates an internal insulated compartment storing a perishable food item from a second compartment storing an additional food item, and to facilitate mixing of the food items within a container without accessing an interior region of the container;

To enable a young child to operate a portable food storage container by gripping a top portion of the container and rotating the top portion to operate a sealing/dispensing mechanism that fluidly couples two food items within the container to facilitate mixing thereof;

To enable an adult to set up food mixture preparations in advance in a portable container configured to fluidly isolate the food items associated with the food mixture, and to fluidly couple the food items upon a particular operation to an exterior portion of the portable container without removing or ripping any portion of the container; and To provide an internal reservoir within the container for storing one of the perishable food items, and a sealing and release mechanism operatively associated with the reservoir, to allow for storage of larger quantities of the perishable food item, and faster release of the contents thereof during operation of the container;

In accordance with one embodiment of the invention, a container comprises a top portion defining a first hollow region configured to store a first product, a bottom portion rotatably coupled to the top portion and defining a second hollow region configured to store a second product, and a sealing and release mechanism configured to fluidly isolate the first and second hollow regions when the top and bottom portions are at rest relative to one another, and to selectively fluidly couple the first and second hollow regions during relative rotation of the top and bottom portions.

In certain embodiments, the sealing and release mechanism is movable between a closed position in which the first hollow region of the top portion is fluidly isolated from the second hollow region of the bottom portion, and an open position in which the first hollow region is fluidly coupled with the second hollow region. Relative rotation of the top and bottom portions causes the sealing and release mechanism to move from the closed position to the open position. The sealing and release mechanism is preferably biased toward the closed position.

In accordance with other embodiments, a method is provided for combining first and second products within a portable container having a top portion and a bottom portion. The method includes pouring a first product into a first hollow region of the top portion via an inlet, adding a second product into a second hollow region defined by the bottom portion, detachably coupling the top and bottom portions with the top and bottom portions completely covering the first and second hollow regions and the first and second hollow regions fluidly isolated from one another, and rotating the top portion relative to the bottom portion to fluidly couple the first and second hollow regions with the top and bottom portions completely covering the first and second hollow regions.

Various other objects, advantages, features, and characteristics of the present invention, as well as the methods of operation and functions of related structural elements, and the combination of parts and economies of development and manufacture, will become readily apparent to those of ordinary skill in the art upon consideration of the detailed description below with reference to the accompanying drawings, all of which form a part of this specification.

BRIEF DESCRIPTION OF THE DRAWINGS

A further understanding of the present invention can be obtained by reference to preferred embodiments set forth in the illustrations of the accompanying drawings. The drawings are not intended to limit the scope of this invention, which is set forth with particularity in the claims as appended or as subsequently amended, but merely to clarify and exemplify the invention. Accordingly, a more complete appreciation of the present invention and many of the attendant aspects thereof may be readily obtained as the same becomes better understood by reference to the following detailed description when considered in conjunction with the accompanying drawings, where:

FIG. 11 is a perspective, partial cutaway view of another alternative embodiment of the assembled container, showing an internal reservoir secured to the top portion, and a screw-on cap with finger slots, in accordance with various embodiments of the invention;

FIG. 12 is a perspective view of the container of FIG. 11, showing the top portion detached from the bottom portion and receiving/guiding milk into the internal reservoir, and a bottom portion of the container with an alternative threading arrangement for facilitating assembly, tightening, and free rotation of the top portion relative to the bottom portion, in accordance with various embodiments of the invention;

FIG. 17 is an enlarged side sectional view of the alternate sealing mechanism in a closed configuration, with a sliding platform and plug member blocking a liquid in the reservoir from exiting an aperture in the reservoir;

FIG. 18 is an additional sectional view of the alternate sealing mechanism, taken through the center of the aperture of the reservoir;

FIG. 19 is a sectional view of a second alternative sealing mechanism, showing an inverted L-shaped bracket, with the sliding platform elevated and closer to the aperture;

DETAILED DESCRIPTION OF THE PRESENT INVENTION

Figures 1, 2:
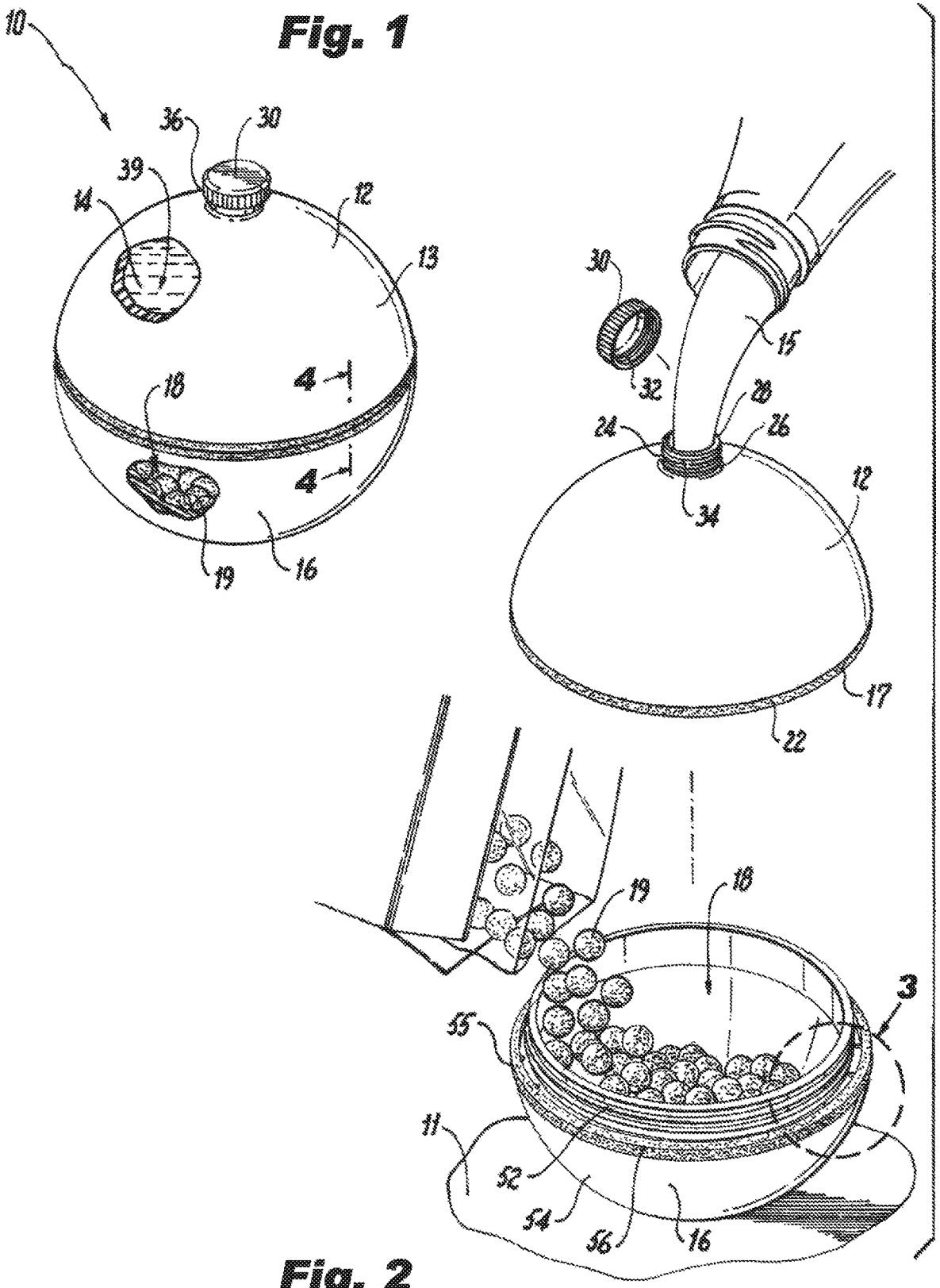
FIG. 1 is a perspective, partial cutaway view of the assembled container in accordance with various embodiments of the invention.
FIG. 2 is a perspective view of the container of FIG. 1 with the top portion detached from the bottom portion and receiving milk, and the bottom portion receiving cereal.

The present disclosure is not intended to be limited to the specific terminology so selected, and it is to be understood that each specific element includes all technical equivalents which operate in a similar manner. Specific embodiments that may be practiced are shown by way of illustration and explanation. The embodiments are described in sufficient detail to enable those skilled in the art to practice the embodiments, and it is to be understood that logical, mechanical, and other changes may be made without departing from the scope of the embodiments. The following detailed description is therefore not to be taken in a limiting sense. In describing exemplary embodiments of the present invention illustrated in the drawings, specific terminology is employed for sake of clarity.

The portable container of the present invention can be used to set up the ingredients of food mixtures, such as milk-cereal or salad-dressing mixtures, in advance. The container fluidly isolates the food component ingredients in separate compartments, and may be locked and transported in this configuration. During a mixing operation, the top portion of the container is rapidly rotated relative to the bottom portion of the container to actuate a sealing and release mechanism. Once actuated, the sealing and release mechanism uncovers an aperture in a compartment or reservoir in the top portion of the container to release one of the food components stored therein into the other food component stored in the bottom portion of the container. As the food components mix, the top and bottom portions of the container fully encapsulate the food mixture, and prevent spillage thereof. The release mechanism is biased toward a sealing configuration, and returns to this sealing configuration upon cessation of rapid relative rotation of the top and bottom portions. The container is reusable, washable, accessible, transportable, and operable by a child or adult to create desired food mixtures from food components at appropriate times while preventing spillage.

Container Structure & Sealing Mechanism

Figure 5:
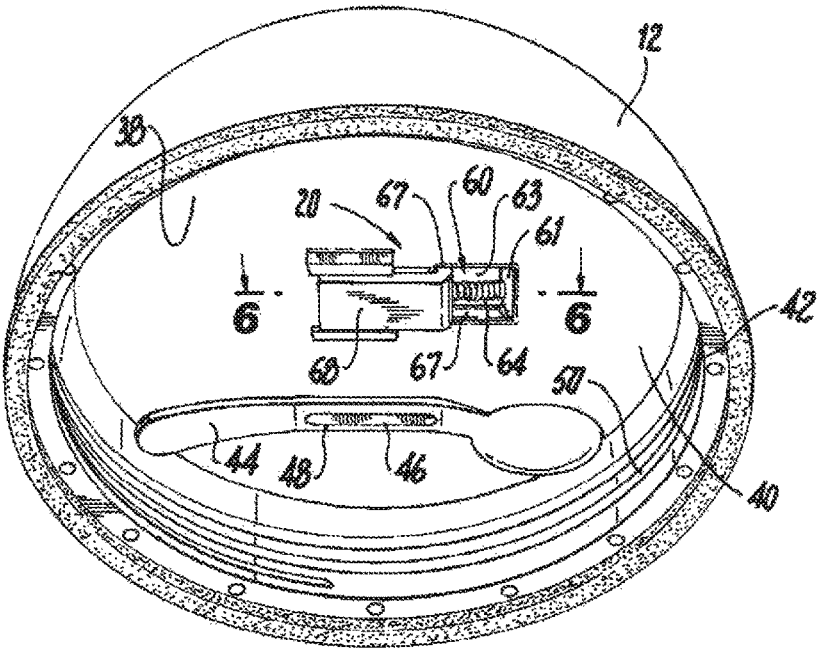
FIG. 5 is a bottom perspective view of the top portion of the container of FIG. 1, showing a plate which forms the bottom of a sealed compartment, a sealing mechanism mounted to the plate, and a spoon mounted to the plate adjacent the sealing mechanism, in accordance with various embodiments of the invention.

Referring to FIGS. 1-2 and 5, a container 10 in accordance with the present invention includes a top portion 12 defining an internal compartment 14 configured to store a first product (e.g., milk 15), a bottom portion 16 rotatably coupled to top portion 12 and defining a hollow region 18 configured to store a second product (e.g., cereal 19), and a sealing mechanism 20 (FIG. 5) configured to selectively fluidly couple internal compartment 14 and hollow region 18 during relative rotation of the top and bottom portions 12, 16. As further discussed below, container 10 is portable and may be used by a young child or an adult to easily mix the milk 15 and cereal 19 separately stored in container 10 at a desired time without (i) spillage, (ii) accessing any interior region of container 10, or (iii) removing or ripping any portion of container 10.

Top portion 12 is preferably bowl shaped, semi-spherical, and sized to completely cover hollow region 18 of bottom portion 16 when placed on and attached to bottom portion 16. Top portion 12 thus functions as a lid during storage and/or mixing of food items within container 10. In certain embodiments, top portion 12 may have a convex outer surface 13 extending to a circumferential edge 17, and a rubber seal 22 applied to circumferential edge 17. Top portion 12 also includes a threaded inlet 24 at an apex 26 thereof for receiving a first food item (e.g., milk 15). Inlet 24 defines an opening 28 in fluid communication with internal compartment 14, whereby milk 15 poured into inlet 24 via opening 28 flows into internal compartment 14. A removable cap 30 is preferably provided which detachably couples to inlet 24. When removable cap 30 is detached from inlet 24, opening 28 is uncovered or exposed.

Removable cap 30 may be provided with female threads 32 which engage with male threads 34 on inlet 24 to threadably engage and tightly fit removable cap 30 to inlet 24 as shown in FIG. 1. Removable cap 30 may be provided with a gripping surface 36 to allow a user to grasp removable cap 30 to either unscrew top portion 12 from bottom portion 16, or to rapidly rotate top portion 12 relative to bottom portion 16 in either a fastening or unfastening direction to operate sealing mechanism 20 to allow for mixture of milk 15 and cereal 19 stored in container 10 as further discussed below. When removable cap 30 is tightly secured to inlet 24 of top portion 12, it is rotatably fixed to top portion 12. Cap 30 can thus be grasped by a user at gripping surface 36 to create such rotation to mix food items stored in container 10. The rotative direction used here to facilitate mixing food items in container 10 is preferably the same direction used to screw top portion 12 onto bottom portion 16, and to screw cap 30 onto top portion 12. To unscrew removable cap 30 from top portion 12, a counter-torque may be applied to convex outer surface 13 of top portion 12 while rotating removable cap 30 in an opposite rotative direction (e.g., an unscrewing counter-clockwise direction).

Internal compartment 14 is preferably lined with rubber and/or other insulators to help maintain the temperature of a food item placed therein and to delay spoilage of the food item. Internal compartment 14 may be constructed as a small internal section of top portion 12 with sidewalls defining a compartment in communication with inlet 24, or may simply be a hollowed region of substantially the entire internal region of top portion 12. By way of example, as shown in FIG. 5, a circular plate 38 may be provided which extends across an interior hollow region 35 of top portion 12 around a circumferential wall 42 thereof. It will be appreciated that in such embodiments, the top of circular plate 38 (not shown) defines a bottom floor of internal compartment 14, and an interior surface 39 (FIG. 1) of top portion 12 defines the sides and top of internal compartment 14. A spoon 44 may be mounted to the bottom of circular plate 38 by any suitable attachment means, such as a hook, an interference fit with plastic protrusions extending from the bottom surface of circular plate 38, Velcro, a hollowed region 46 through which a peg 48 is inserted via interference fit, etc.

Continuing with reference to FIG. 5, circular plate 38 may be formed as a separate piece attached to circumferential wall 42 of top portion 12 by press or interference fit, or may be integrally formed with circumferential wall via injection molding, blow molding, or other suitable manufacturing means. For example, circumferential wall 42 may define grooves configured to receive circular plate 38, and such grooves and/or plate 38 may be lined with rubber to provide effective sealing when plate 38 is press fit into the grooves. Other attachment means may be used to provide adequate sealing of internal compartment 14. Sealing mechanism 20 may be permanently attached to circular plate 38, or may be detachable therefrom. In this manner, top and bottom portions 12, 16, circular plate 38, and sealing mechanism 20 may be dishwasher safe, separately or jointly washable, and reusable.

Below circular plate 38, circumferential wall 42 defines female threads 50 configured to receive male threads 52 (FIGS. 2-4) disposed on bottom portion 16 of container 10, whereby top portion 12 may be attached to bottom portion 16 via threaded engagement of respective male and female threads 52, 50. Once milk 15 and cereal 19 have been added to top portion 12 and bottom portion 16 respectively, top portion 12 may be gently screwed onto bottom portion 16, preferably with relatively constant angular speed so as to not release or open sealing mechanism 20 (further discussed below with respect to FIG. 6).

Bottom portion 16 of container 10 is also preferably bowl shaped, semi-spherical, and sized to hold one or more servings of cereal. Bottom portion also preferably has a convex outer surface 54 extending to a circumferential edge 55, and a rubber seal 56 applied to thereto. It will be appreciated that when top portion 12 is fully screwed onto bottom portion 16, rubber seal 56 of bottom portion 16 will contact rubber seal 22 of top portion 12. Rubber seals 22, 56 may compress one another in the assembled configuration of FIG. 1 to seal and preserve one or more food items within hollowed region 18 of bottom portion 16. One or more food items will also be sealed and preserved in sealed compartment 14 of top portion 12 by virtue of cap 30 (which may be configured as a child proof cap), and sealing mechanism 20, which will remain in the closed position until container 10 is operated to mix the food items stored therein. A bottom region of bottom portion 16 may be equipped with a rubber stand or support (not shown) for resting on a flat surface and supporting container 10. Alternatively, the bottom region of bottom portion 16 may define a flat section to prevent bowl shaped bottom portion 16 from tilting or rolling on a flat surface 11 such as a table.

Figure 3:
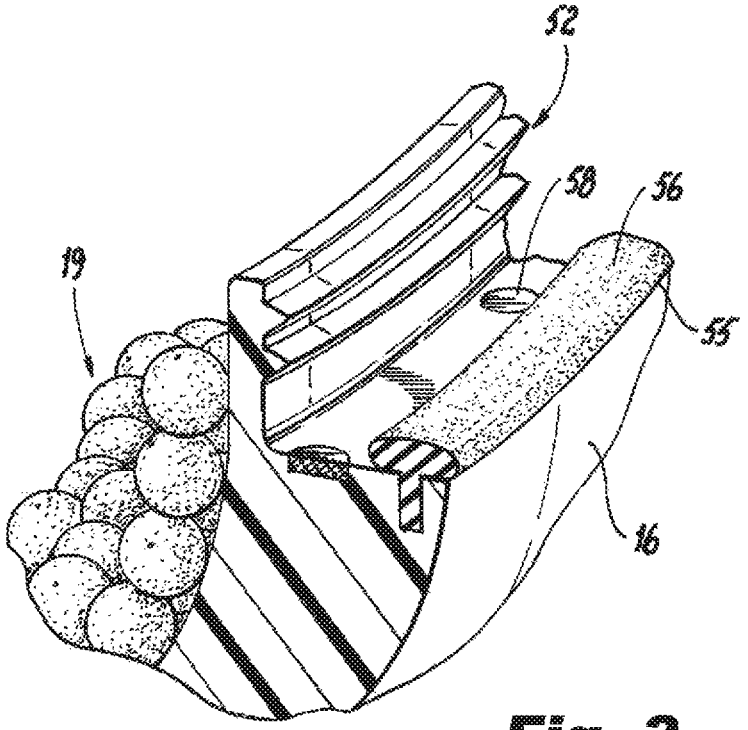
FIG. 3 is an enlarged view of a section of the bottom portion of the container of FIG. 2.
Figure 4:
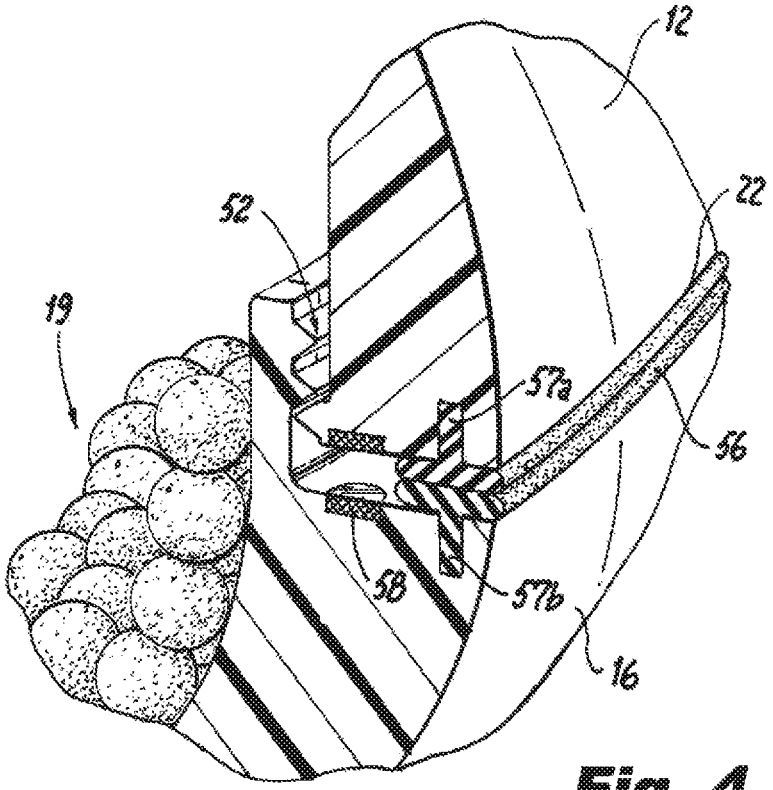
FIG. 4 is an enlarged view of a section of the top portion and a section of the bottom portion of the container of FIG. 1 in an assembled configuration.

As best shown in FIGS. 3-4, rubber seals 22, 56 may be attached to top and bottom portions 12, 16 respectively by being press-fit into grooves 57*a*, 57*b* operatively disposed in top and bottom portions 12, 16 along the circumferential edges 17, 55 thereof, and by adhesive or other attachment means. In certain embodiments, magnets 58 may be provided along circumferential edges 17, 55 of top and bottom portions 12, 16 to help hold top and bottom portions 12, 16 together in the assembled configuration of FIG. 1. In other embodiments, magnets 58 may be operatively disposed inside rubber seals 22, 56.

Figure 6:
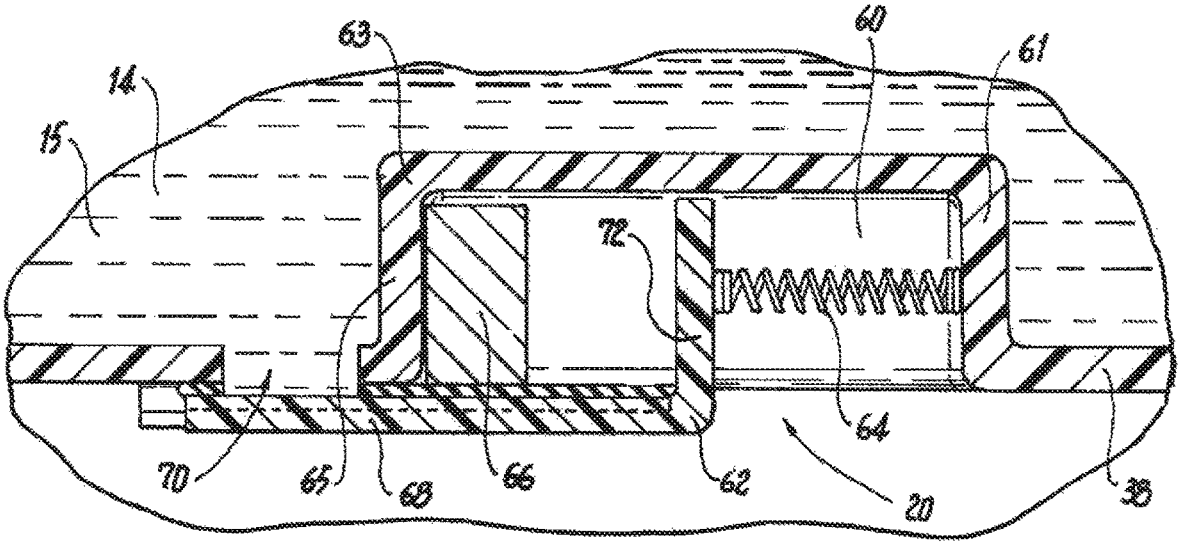
FIG. 6 is an enlarged sectional view of the sealing mechanism of FIG. 5 in a closed position.

Referring to FIGS. 5-6, sealing mechanism 20 is mounted to the bottom of or within circular plate 38. As shown, circular plate 38 defines a recess 60 configured to receive a portion of sealing mechanism 20. Recess 60 is defined by walls 61, 63, 65, 67, 69 of circular plate 38. In certain embodiments, sealing mechanism 20 may be snap fit into recess 60 (FIG. 5). Sealing mechanism 20 includes an L-shaped bracket 62, a spring 64, and a weight 66. Spring 64 biases L-shaped bracket 62 in a closed position as shown in FIG. 6, where sealing arm 68 of bracket 62 covers a bottom opening 70 in internal compartment 14 housing milk 15, and thus fluidly isolates milk 15 from hollow region 18 of bottom portion 16. Weight 66 freely translates within recess 60, but is bounded by circular plate 38 above and on the sides thereof, and by the radial location of second arm 72 of bracket 62, which is coupled to spring 64 and biased toward the closed position. It will be appreciated that other shapes or types of bracket 62 may be utilized. For example, in certain embodiments, bracket 62 may instead be a compressible rubber flap which is compressed and seals opening 70 when sealing mechanism 20 is in the closed position.

Figure 7:
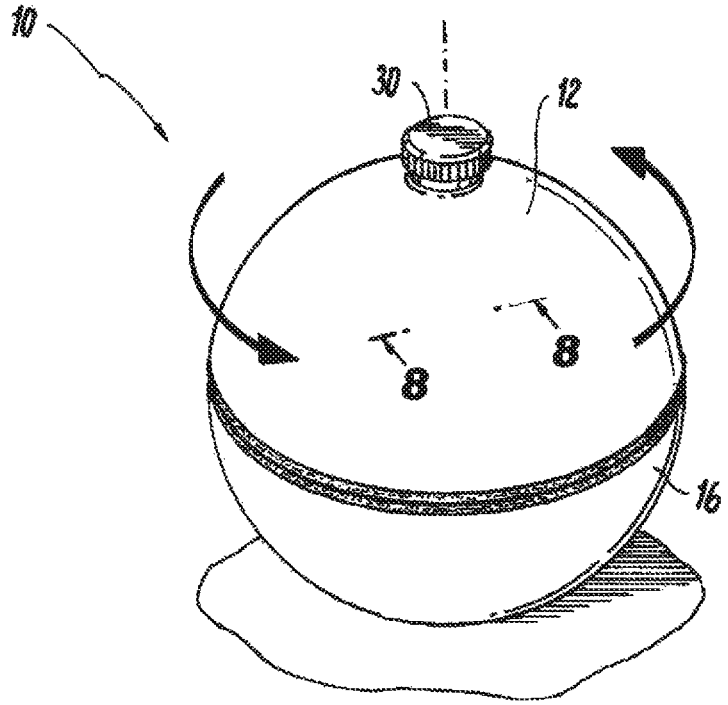
FIG. 7 is a perspective view of the container of FIG. 1 with the top portion spinning relative to the bottom portion.
Figure 8:
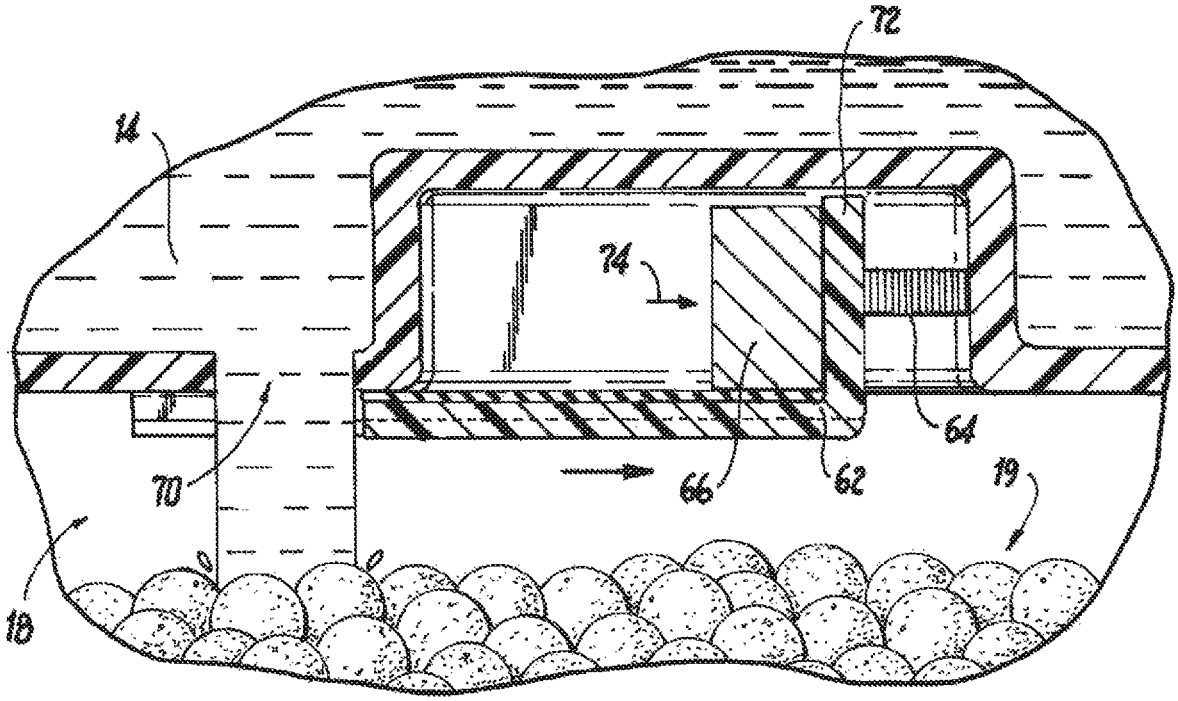
FIG. 8 is an enlarged sectional view of the sealing mechanism of FIG. 5 in an open position with milk flowing from an internal compartment of the top portion into a hollow region of the bottom portion while the top portion of the container is spinning.

Referring to FIGS. 7-8, when top and bottom portions 12, 16 are threadably engaged, relatively fast rotation therebetween causes free floating weight 66 to be biased radially outward in the direction of arrow 74. While this phenomenon is known by some as "centripetal force," it will be appreciated by those skilled in the art that such effect results from Newton's Laws governing objects in motion. The natural tendency of weight 66 is to move in a straight line tangential to the direction of rotation. When angular acceleration is applied to top portion 12, without recess 60, weight 66 would move tangential to the direction of rotation (similar, for example, to when a bucket of water is swung overhead). However, since recess 60 provides room for weight 66 to move radially outward, weight 66, once moving, has momentum and resists any change in velocity (e.g., a change in speed or direction).

The forced acceleration of top portion 12 combined with the degree of freedom provided by recess 60 biases weight 66 radially outward against second arm 72 of bracket 62, and against the bias of spring 64. Bracket 62 thus also translates radially outward, and sealing arm 68 of bracket 62 uncovers or exposes bottom opening 70, allowing milk 15 to flow from internal compartment 14 into hollow region 18 of bottom portion 16. It will be appreciated that in certain embodiments, if bracket 62 contains enough mass, it may function as a weight itself, and will be biased radially outward against spring 64. In such embodiments, no weight 66 is needed.

It will be appreciated that the force applied by spring 64 corresponds to the equation $F=kx$, where 'F' is the force applied by the spring, k is a constant spring coefficient, and 'x' is the displacement of spring 64 (e.g., displacement of a section of spring mounted to second arm 72 of bracket 62). It will also be appreciated that a spring may be utilized which, absent relative rotation of top and bottom portions 12, 16 (or with minor or slow/steady rotation used to screw/unscrew top portion 12 to/from bottom portion 16), maintains sealing mechanism 20 in the closed position. However, spring 64 may also be sufficiently weak to enable a child to provide sufficient angular acceleration to top portion 12 to move sealing mechanism 20 from the closed position to the open position. Finally, it will be appreciated that either direction of rotation (e.g., clockwise or counterclockwise) will cause sealing mechanism 20 to move from the closed position to the open position. Sealing mechanism 20 is preferably mounted off-center to circular plate 38 (e.g., so that weight 66 is not disposed in the exact center of circular plate 38) to create the effects described above.

In certain embodiments, bottom portion 16 may include a horizontal thread operatively disposed below male threads 52 of bottom portion 16 and above bottom seal 56. For example, once top portion 12 has been fully screwed onto bottom portion 16, it may be configured to fully navigate female threads 52 and then drop onto such horizontal thread and be rotated continuously without being further screwed onto or unscrewed from bottom portion 16. Container 10 may be configured without seals 17, 56 so that when top portion 12 is rapidly rotated on the horizontal thread of bottom portion 16, there are no seals do not resist such rotation. Alternatively, low friction seals may be utilized which do not significantly inhibit rotation of top portion 12 on such horizontal thread.

Container Operation

It will be appreciated that the portable container disclosed herein may be utilized using a number of different methodologies. An exemplary methodology may include, for example, removing cap 30 from top portion 12, pouring milk 15 into internal compartment 14 of top portion 12 via exposed inlet 24, attaching cap 30 back onto inlet, pouring cereal 19 into hollow region 18 of bottom portion 16, placing top portion 12 over bottom portion 16, and slowly rotating top portion 12 relative to bottom portion 16 while bottom portion 16 is on flat surface 11. Such rotation is preferably done slowly and with relatively constant angular speed to ensure that sealing mechanism 20 does not release milk 15 into cereal 19. Once top portion 12 is fully screwed onto bottom portion 16 with seals 22, 56 touching one another, container 10 may be placed in a refrigerator for the night, and taken to school or work the following day.

Upon arrival at school or work, container 10 may be placed in a new refrigerator or operated in one of a number of different modes to create the cereal-milk mixture. A first mode of operation to create the milk-cereal mixture from the assembled container 10 utilizes a twisting motion as follows. With top and bottom portions 12, 16 fully assembled, top portion 12 may be quickly rotated in an unscrewing direction (e.g., counterclockwise) as shown in FIG. 7, then quickly in a clockwise (opposite direction), and repeated. In other words, a child can place his/her hand on cap 30 and/or exterior surface 13, and twist top portion 12 back and forth a few times (e.g., counterclockwise, clockwise, counterclockwise, clockwise, etc) without taking his/her hand off of the container 10. This will have the effect of repeatedly opening and closing sealing mechanism 20, causing all of the milk 15 to drain out of internal compartment 14 into bottom portion 16 while bottom portion 16 is fully covered by top portion 12.

In a second mode of operation, top portion 12 may be slowly rotated at relatively constant speed in an unscrewing direction. During such motion, sealing mechanism 20 will not move to the open position because not enough force will be generated to move bracket 72 against the bias of spring 64 (with or without weight 66). Once top portion 12 has partially traversed its threaded engagement with bottom portion 16 in the unscrewing direction, top portion 12 can then be quickly turned in the screwing (e.g., clockwise) direction, causing the sealing mechanism 20 to open and release milk 15. This second mode of operation may also be repeated one or more times to ensure all milk 15 has been emptied into cereal 19 in bottom portion 16.

In a third mode of operation, if bottom portion 16 is configured with a horizontal thread as described above (or with a gap between the threads as further described below), then once top portion 12 can be continuously rotated on a horizontal thread at a relatively high speed in either the clockwise or counterclockwise direction. Top portion 12 can then be pulled upward and turned in an unscrewing (e.g., counterclockwise) direction, whereby it will engage once again with male threads 52 and unscrew from bottom portion 16.

It will be appreciated that during operation of container 10 in any of these three modes, no parts are removed or ripped therefrom. Additionally, no portion of the container's interior is accessed, and milk 15 and cereal 19 are fully shielded at all times by top and bottom portions 12, 15, which remain detachably coupled to one another in threaded engagement. This will prevent spillage of the milk or cereal from the container 10, and enable the milk-cereal mixture to be formed at any convenient time. It will also be appreciated that other food items may be utilized. For example, instead of cereal in bottom portion 16, salad may be utilized. Instead of milk in internal compartment 14 of top portion 12, salad dressing such as an oil/vinegar mixture may be utilized. It will also be appreciated that container 10 may be used for non-food products where it is desired to keep the products separate until an appropriate time. In fact, if an oil/vinegar mixture is utilized in internal compartment 14, then even if such mixture separates overnight, rotation of top portion 12 to operate container 10 to mix the food items will cause the oil and vinegar to swirl inside internal compartment 14 before and while it is transferred through opening 70, thus making for a better salad-dressing mixture.

Figure 9:
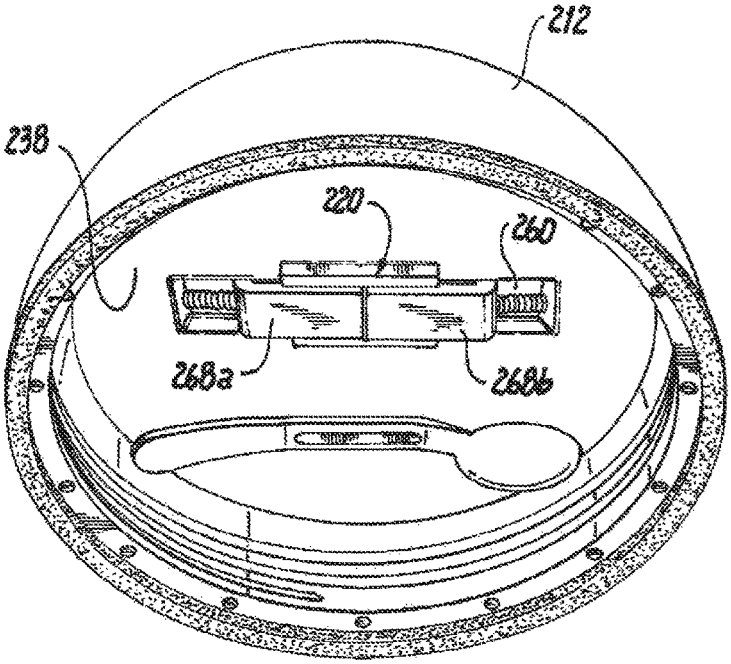
FIG. 9 is a bottom perspective view of the top portion of an alternative embodiment of the container, showing a plate which forms the bottom of a sealed compartment, an alternative sealing mechanism mounted to the plate, and a spoon mounted to the plate adjacent the alternative sealing mechanism, in accordance with various embodiments of the invention.
Figure 10:
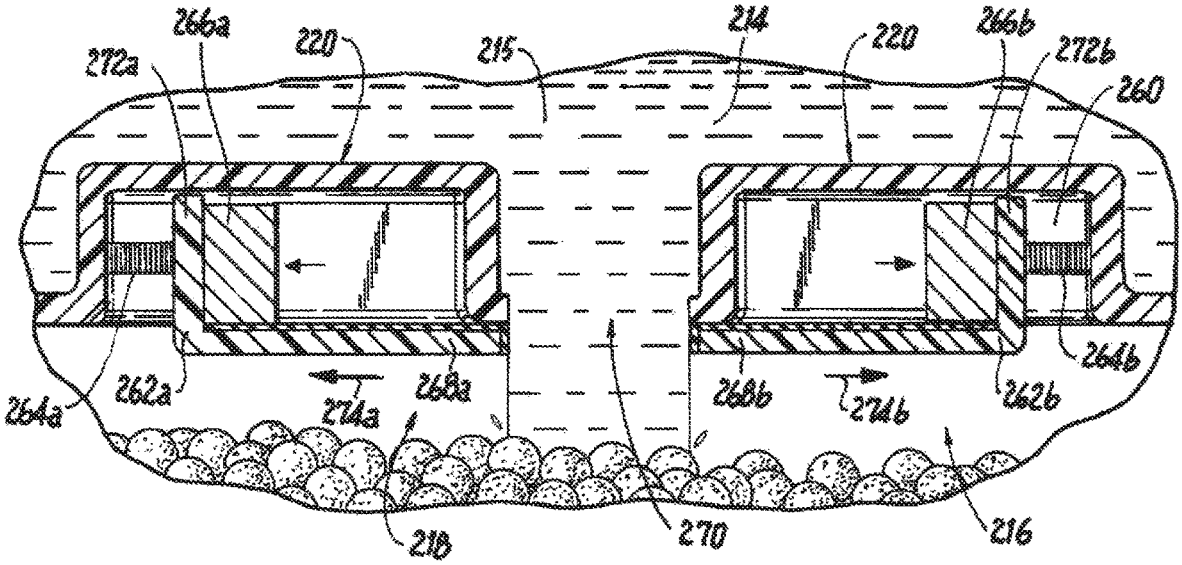
FIG. 10 is an enlarged sectional view showing the alternative sealing mechanism of FIG. 9 in an open position with milk flowing from an internal compartment of the top portion into a hollow region of the bottom portion while the top portion of the container is spinning, in accordance with various embodiments of the invention.

Referring to FIGS. 9-10, shown is an alternative embodiment of a sealing mechanism 220 mounted within a recess 260 defined by a circular plate 238 of a top portion 212 of an alternative embodiment of the container. As shown, recess 260 is configured to receive a portion of sealing mechanism 220, which may be snap fit therein as discussed above. Sealing mechanism 220 includes a pair of brackets 262*a*, 262*b*, and rotation of the top portion 212 relative to the bottom portion 216 causes the pair of brackets 262*a*, 262*b* to diverge from one another and expose an opening 270 in an internal compartment 214 in fluid communication with hollow region 218 of bottom portion 216. Springs 264*a*, 264*b* bias respective brackets 262*a*, 262*b* (FIG. 10) toward a closed position in which they are pressing one another and covering (sealing) opening 270 as shown in FIG. 9. In this closed position, sealing arms 268*a*, 268*b* of brackets 262*a*, 262*b* cover bottom opening 270, and thus fluidly isolate milk 215 from hollow region 218 of bottom portion 216. Weights 266*a*, 266*b* freely translate within recess 260, but are bounded by circular plate 238, and by the radial location of second arms 272*a*, 272*b* of brackets 262*a*, 262*b*, which are respectively coupled to springs 264*a*, 264*b* and biased toward the closed position. When top and bottom portions 212, 216 are threadably engaged, fast relative rotation therebetween causes free floating weights 266*a*, 266*b* to be biased radially outward in opposite directions 274*a*, 274*b*. It will be appreciated that clockwise or counterclockwise rotation of top portion 212 relative to bottom portion 216 will cause weights 266*a*, 266*b* and brackets 262*a*, 262*b* to diverge from one another, and thus for sealing mechanism 220 to move from the closed position of FIG. 9 to the open position of FIG. 10.

The container components described herein, including bracket 62, weight 66, and spoon 44 are preferably made of plastic, although other materials may be utilized. In certain embodiments, if container 10 will be operated by a very small child, then weight 66 may be permanently sealed inside sealing mechanism 20 so there is no chance that a small child tinkering with top portion 12 can remove it. As discussed above, sealing the mechanism may be permanently mounted within plate 38. In yet other embodiments, the sealing mechanism may be a removable spherical piece shaped like top portion 12.

Alternative Container With Reservoir And Radially Outer Sealing/Release Mechanism Referring to FIGS. 11-12 and 14-16, in another alternative embodiment, an assembled container 100 includes a top portion 112, an internal reservoir 114 secured to top portion 112 for storing milk 15, a bottom portion 116 rotatably coupled to top portion 112, a removable cap 130, and a radially outer sealing/release mechanism 120 for fluidly isolating and temporarily/selectively fluidly coupling milk 15 and cereal 19. The structure, shape, and function of container 100 and the various components thereof may be similar to the structure, shape, and function of corresponding components described above with respect to container 10. Thus, it will be appreciated that certain components described above with respect to container 10 which are not described with respect to container 100 may be used with container 100 in the same manner. Container 100 provides additional advantages to the user, and differs from container 10 as described below.

Removable cap 130 of container 100 may include rib 134 and finger slots 131A, 131B which allow a user to grasp cap 130 and twist it off in an unscrewing (e.g., counterclockwise) direction, or to twist it in a tightening (e.g., clockwise) direction. Cap 130 includes external threads 133 which engage inner threads 135 of an upper neck portion 136 of top portion 112. Cap 130, once fastened to upper portion 112, can also be used to turn upper portion 112 clockwise or counterclockwise to screw or unscrew upper portion 112 onto or off of lower portion 116. Cap 130 may also be used to grasp and rapidly spin upper portion 112 in clockwise and/or counterclockwise directions in one of the three modes described above with respect to container 10, to continue turning upper portion 112 in a clockwise direction to lock it into bottom threads of lower portion 116, and/or to pull upper portion 112 upward while turning it to reengage threads and remove upper portion 112 (further described below).

Figure 14:
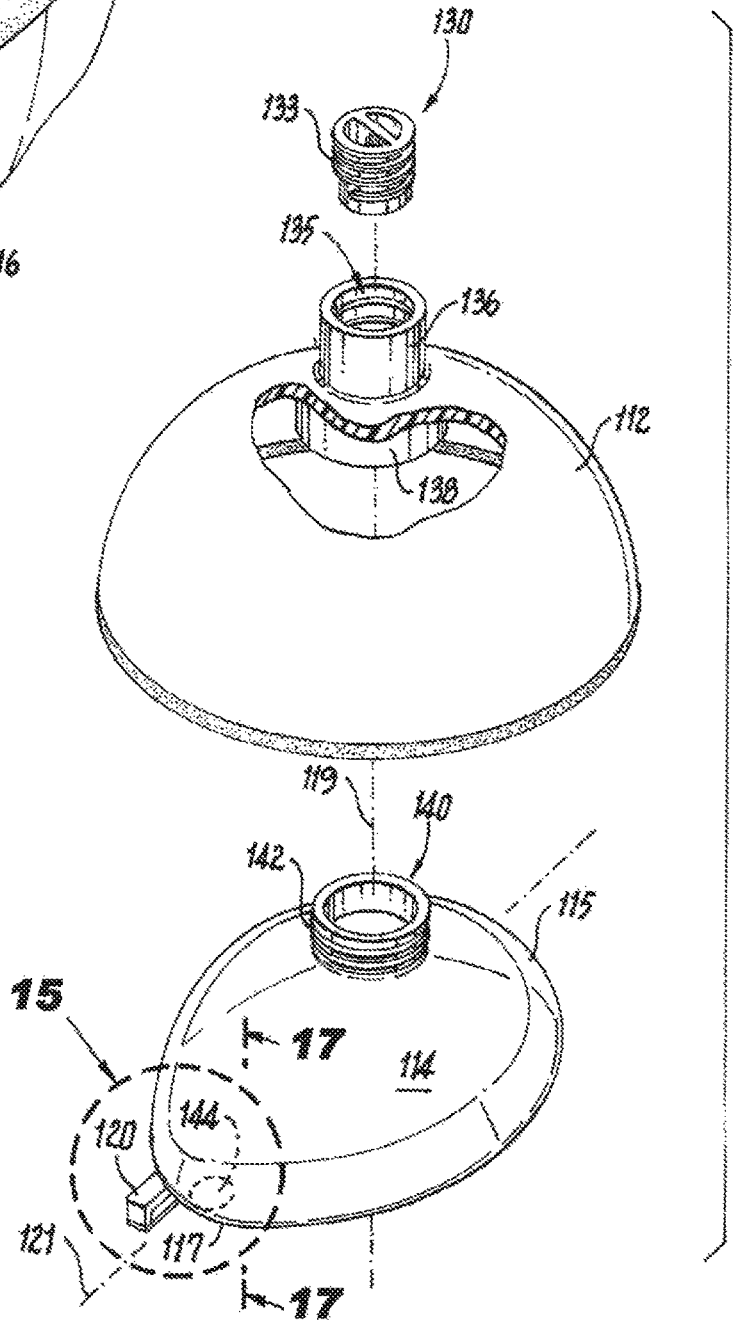
FIG. 14 is an exploded view of the screw-on cap, top portion, and reservoir of the container of FIG. 11, with an alternative sealing/release mechanism attached to the reservoir.
Figure 15:
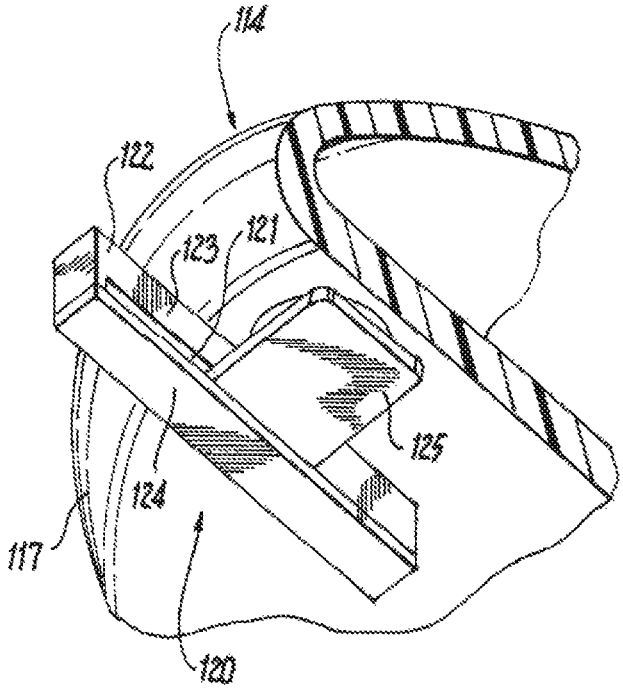
FIG. 15 is an enlarged bottom perspective view of a section of the reservoir and the alternative sealing mechanism.
Figure 16:
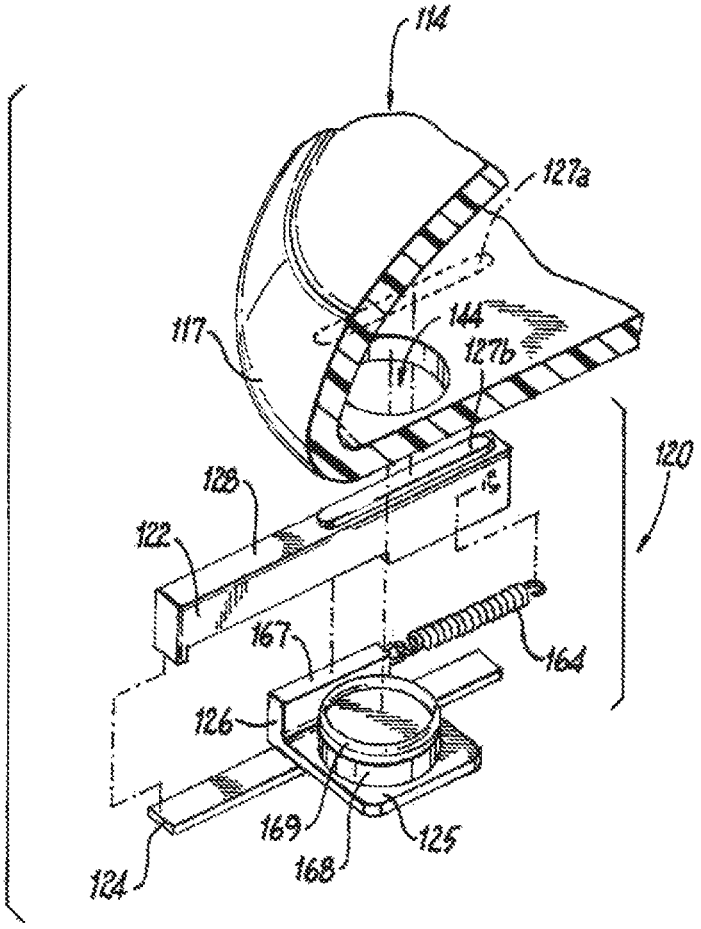
FIG. 16 is an exploded view of a section of the reservoir and the alternative sealing mechanism.
Figure 20:
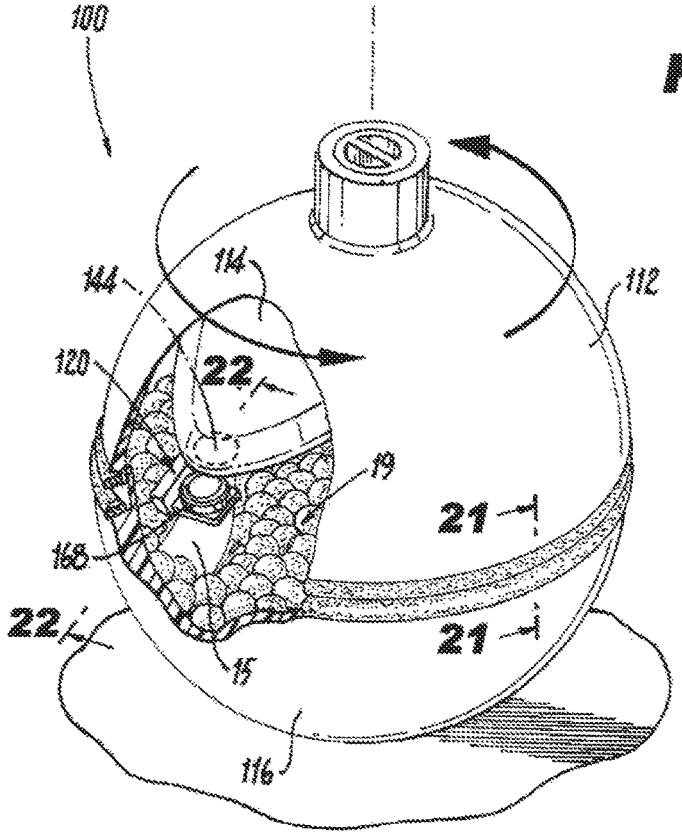
FIG. 20 is a perspective, partial cutaway view of the assembled container of FIG. 11 in operation, with the top portion being rotated relative to the bottom portion, the alternative sealing/release mechanism in the open position, and milk exiting the aperture in the reservoir into cereal in the lower portion.

Similar to top portion 12, top portion 112 is bowl-shaped and semi-spherical, but also includes upper neck portion 136 for receiving milk 15, screw-on cap 130, and lower neck portion 138 for receiving and securing internal reservoir or funnel 114 (FIG. 14). Upper neck portion 136 and lower neck portion 138 may be integrally formed with top portion 112, or configured as separate pieces which permanently or detachably couple to top portion 112. Lower neck portion 138 may be configured with internal threads for receiving external threads 140 of an upper neck portion 142 of internal reservoir 114.

The threaded engagement of reservoir/funnel 114 and top portion 112 via engagement of lower neck portion 138 and upper neck portion 142, while detachable, is preferably rigid, and requires significant force to unscrew/detach such that reservoir 114 can only be removed by an adult or older child, and does not loosen during operation of container 100. The detachable engagement of reservoir 114 and top portion 112 may additionally or alternatively be accomplished by any suitable latching or interference fit mechanism known in the art which provides a secure engagement during spinning of top and bottom portions 112, 116 relative to one another. Once fixed to top portion 112, reservoir rotates with top portion 112 when top portion 112 is rapidly rotated as described herein.

Internal reservoir or funnel 114, best shown in FIG. 14, is a separate container which attaches to upper portion 112 via engagement of lower neck portion 138 and upper neck portion 142 as described above. Reservoir 114 may be configured with a funnel shape, preferably with a larger convex end 115 and a narrower end 117, which may also be convex. As shown, reservoir 114 is tilted relative to the axis 119 along which necks 136, 138, 142 extend. Reservoir 114 may also be disc-shaped, and extend along axis 121, whereby larger convex end 115 is elevated relative to narrower end 117. It will be appreciated that by elevating convex end 115 relative to narrower end 117, milk 15 stored in reservoir 114 is biased toward narrower end 117 under the force of gravity and the shape of reservoir 114. It will also be appreciated that by orienting reservoir 114 at an angle relative to axis 119 (e.g., with axis 121 intersecting axis 119 at an acute angle, reservoir 114 may be lengthened without touching the inner surface of top portion 112 as its periphery will take up less of a horizontal footprint across the interior of upper portion 112 than it would if it were oriented horizontally. Narrower end 117 of reservoir 114 defines an aperture 144 for releasing milk 15 from reservoir 114 when sealing mechanism 120 is moved to the open configuration as further described below.

Figure 13:
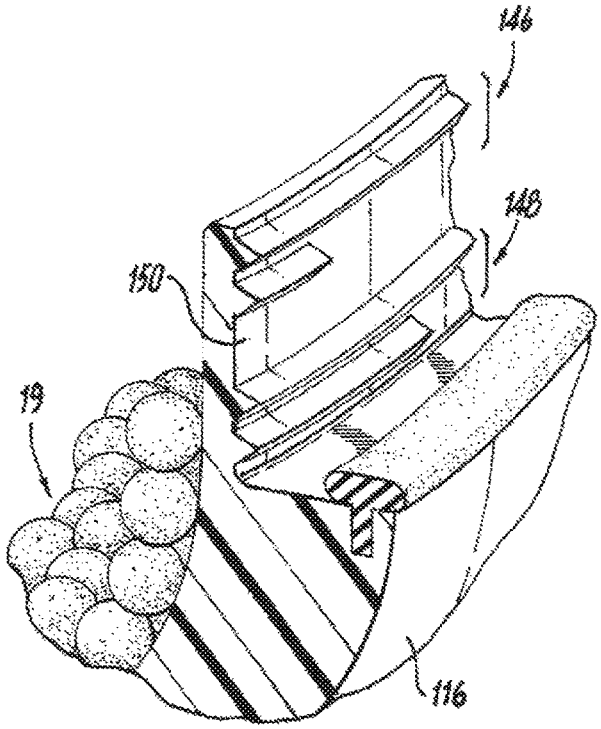
FIG. 13 is an enlarged view of a section of the bottom portion of the container of FIG. 11, showing the threads defining a gap for allowing free spinning of the top and bottom portions relative to one another.
Figure 21:
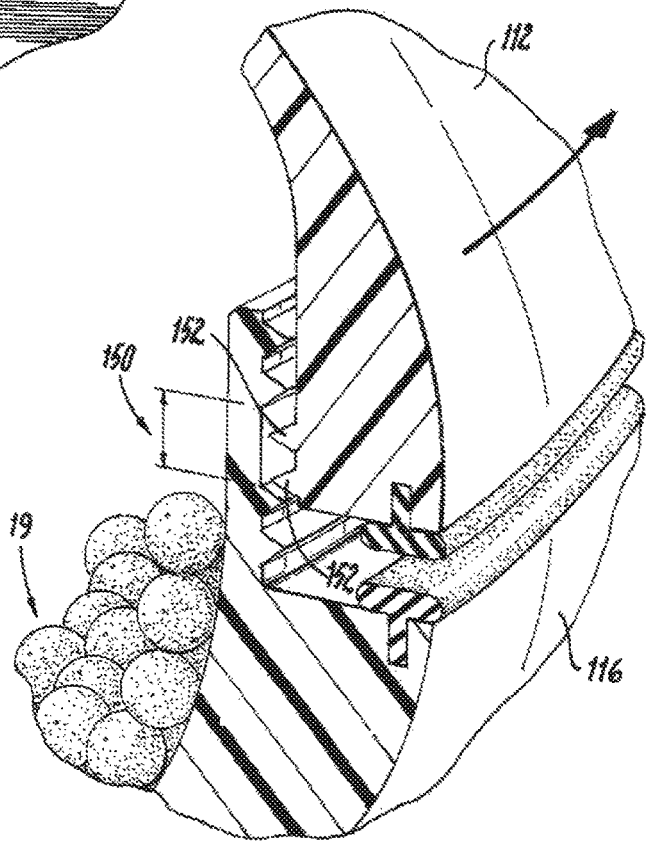
FIG. 21 shows an enlarged sectional view of the assembled container of FIG. 11 in operation, showing threads of the top portion riding in a gap between top and bottom threads of the bottom portion.

As best shown in FIG. 13, bottom portion 116 includes upper external threads 146 and lower external threads 148, and defines a gap 150 between upper and lower external threads 146, 148. Upper external threads 146 are configured to attach threads 152 (FIG. 21) of top portion 112 as described above with respect to top portion 12 of container 10. Lower external threads 146 may also be placed in threaded engagement with threads 152 of top portion 112, and used to lock top portion 112 to lower portion 116. When external threads 152 of top portion 112 are within gap 150, top portion 112 freely spins relative to lower portion to disengage sealing mechanism 120. For example, once threads 152 are disposed in gap 150, top portion 112 can be spun quickly in a counterclockwise direction so that threads 152 do not catch lower external threads 148 of bottom portion 116. Alternatively, spinning of top portion 112 can be done, for example, with rapid succession of clockwise, counterclockwise, clockwise, counterclockwise twisting. Once threads 152 of top portion 112 are in gap 150 and spun to release milk 15, top portion 112 may be removed from bottom portion 116 by grasping finger slots 131A, 131B of cap 130, lifting top portion 112, and rotating top portion 112 counterclockwise relative to bottom portion 116, whereby threads 152 will catch top external threads 146 of bottom portion 116, and unscrew top portion 112 from bottom portion 116.

As shown in FIGS. 15-18 and 20, sealing/release mechanism 120 includes a hollow housing 122 defining a slot 121 between a sidewall 123 of housing 122 and a bottom cover 124 of housing for guiding translation of a platform section 125 of an L-shaped bracket 126 mounted within housing 122. Housing 122 may be rectangular shaped and fixed to the bottom of reservoir 114 adjacent aperture 144. For example, housing 122 may define a recess 127*a* configured to receive a rib 127*b* (FIG. 16) on top surface 128 of housing 122. Any suitable attachment mechanism may be utilized to mount housing 122 to reservoir 114.

Mechanism 120 also includes a spring 164 having a first end 164*a* mounted to a radially inner end 165 of housing 122, and a second end 164*b* mounted to a radially inner side of a retaining portion 167 of L-shaped bracket 126 as shown. Retaining portion 167 of bracket 126 is movably retained within and encapsulated by hollow housing 122, and allowed to translate radially outward along housing 122 when top portion 112 of container 100 is rotated. Spring 164 is also retained in and fully encapsulated by housing 122. A plug member 168 is provided on top of platform section 125 of L-shaped bracket 126 for forming a seal with aperture 144 when sealing mechanism 120 is in the closed position (with spring 164 retracted).

Figure 22:
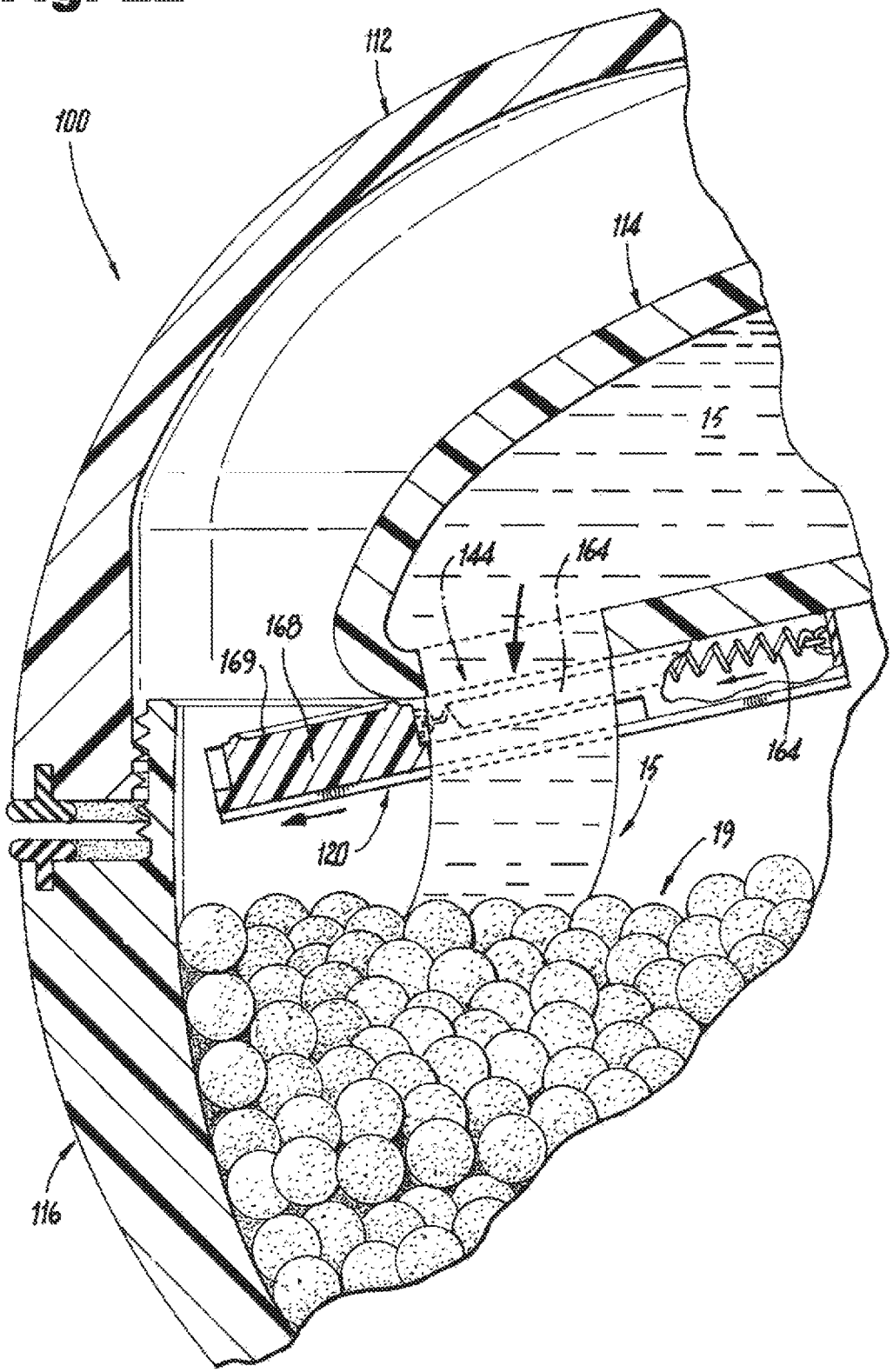
FIG. 22 shows an enlarged sectional view of the alternative sealing mechanism in an open configuration, with the milk pouring through a hole in the internal reservoir, and into the bottom portion.

Plug member 168 may be integrally formed with bracket 126 or provided as a detachable piece. Plug member 168 may also be provided with an O-ring or a rib 169 at the top thereof for providing a seal with the bottom edge of aperture 114 when sealing mechanism 120 is in the closed position. It will be appreciated that rib 169 should be sufficiently large to prevent leakage or seepage of milk 15 from exiting aperture 114, but also small enough to allow plug member 168 to come out of aperture 114, and translate radially outward with bracket 126 to the position shown in FIG. 22, when top portion 112 of container 100 is rapidly spun to release milk 15.

As shown in FIG. 17, when sealing/release mechanism 120 is in the closed position, rib 169 atop plug member 168 abuts wall 171 of reservoir 114 defining aperture 144. In certain embodiments, plug member 168 may be replaceable on platform section 125 with different sizes and/or vertically adjustable from platform section 124 in order to increase the amount which rib 169 extends into aperture 144, if at all. Alternatively, different sized O-rings may be utilized atop plug member 168 to provide proper sealing and release of milk 15 when container 100 is operated.

As shown in FIG. 19, in another embodiment, a sealing/release mechanism 120' may be configured with an L-shaped bracket 126' inverted such that a platform section 125' extends through a slot 121' at the top of a hollow housing 122'. In this manner, no plug member is provided, and platform section 125' simply slides, along with compressible rubber surface 173' bonded to platform section 125', radially inward and outward (out of the page in FIG. 19) to alternately uncover and reseal aperture 144 as container 100 is operated to release milk 15.

It will be appreciated that in sealing/release mechanism 120, there is no separate weight component as bracket 126 functions as the weight. In certain embodiments, portions of bracket 126 inside housing 122 may be made of a heavier weight material, whereas rib 169 and/or platform section 125, which will have some contact with the milk, may be formed from plastic. Housing 122 may also be made of plastic.

Container 100 is reusable and allows for easy detachment of reservoir 114 for washing. It will be appreciated that the shape and tilt of reservoir 114 will better bias milk toward aperture 144 during rapid rotation of top portion 112 (with reservoir 114) relative to bottom portion 116. Additionally, by mounting sealing/release mechanism 120 at a radially outer portion of top portion 112 (e.g., at a radially outer portion of reservoir 114 within top portion 112), release mechanism 120 is moved through a greater speed/acceleration for a given rotational speed/acceleration of top portion 112. For example, bracket 126 is moved/accelerated as a function of both the rotational velocity/acceleration applied to top portion 112 and the distance (radius) from the center of top portion 112 to the bracket 126. In this manner, the momentum and inertia of bracket 126 is greater at a radially outer position, being unable to move in a straight direction tangential to the direction of spin, is more easily biased radially outward to release the milk during rapid rotation of top portion 112.

The present invention has been described in the context of a number of embodiments, and multiple variations and examples thereof. It is to be understood, however, that other expedients known to those skilled in the art or disclosed herein may be employed without departing from the spirit of the invention.

Therefore, it is intended that the appended claims be interpreted as including the embodiments described herein, the alternatives mentioned above, and all equivalents thereto.

What is claimed is:

1. A container, comprising:

a top portion defining a first hollow region configured to store a first product;

a bottom portion rotatably coupled to the top portion and defining a second hollow region configured to store a second product; and a sealing and release mechanism configured to fluidly isolate the first and second hollow regions when the top and bottom portions are at rest relative to one another, and to selectively fluidly couple the first and second hollow regions during relative rotation of the top and bottom portions, wherein the sealing and release mechanism is movable between a closed position in which the first hollow region of the top portion is fluidly isolated from the second hollow region of the bottom portion, and an open position in which the first hollow region is fluidly coupled to the second hollow region, wherein the sealing and release mechanism is biased toward the closed position, and relative rotation of the top and bottom portions causes the sealing and release mechanism to move from the closed position to the open position, and wherein the sealing and release mechanism includes a bracket, rotation of the top portion relative to the bottom portion causes the bracket to move toward the open position against the bias of a spring, and radially outward translation of the bracket uncovers an opening placing the first hollow region of the top portion in fluid communication with the second hollow region of the bottom portion.

2. A container according to claim 1, wherein the sealing and release mechanism further includes the spring biases the bracket toward the closed position, and a weight operatively associated with the bracket for moving the bracket.

3. A container according to claim 1, wherein at least a portion of the first product moves through the opening and enters the hollow region of the bottom portion while the opening is uncovered.

4. A container according to claim 1, wherein the first product is milk and the second product is cereal.

5. A container according to claim 1, further comprising:

a reservoir attached to the top portion for receiving the first product inside the top portion, wherein the top portion defines an inlet in fluid communication with the reservoir.

6. A container according to claim 5, further comprising:

a cap with finger grips configured to allow manual gripping of the cap to rotate the top portion relative to the bottom portion.

7. A container according to claim 1, further comprising:

a first rubber seal attached to an outer rim of the top portion;

a first magnet disposed within the first rubber seal;

a second rubber seal attached to an outer rim of the bottom portion; and a second magnet disposed within the second rubber seal, wherein the first and second rubber seals are configured for sealing engagement with one another, and the first and second magnets are configured to maintain the sealing engagement during transport of the container with the first product in the first hollow region and the second product in the second hollow region.

8. A container according to claim 1, wherein the top portion includes an internal plate defining a floor of an internal chamber, and wherein the internal plate includes a cutout region configured to receive at least a portion of the sealing and release mechanism.

9. A container according to claim 8, wherein the internal plate is configured to mount a spoon within the top portion adjacent the sealing and release mechanism.

10. A container according to claim 1, wherein rotation of the top portion relative to the bottom portion causes the at least one bracket to move to expose the opening, and the opening is configured to allow the first product to flow into the second hollow region containing the second product.

11. A container, comprising:

a top portion defining a first hollow region configured to store a first product;

a bottom portion rotatably coupled to the top portion and defining a second hollow region configured to store a second product; and a sealing and release mechanism configured to fluidly isolate the first and second hollow regions when the top and bottom portions are at rest relative to one another, and to selectively fluidly couple the first and second hollow regions during relative rotation of the top and bottom portions, wherein the bottom portion is a bowl-shaped member in threaded engagement with the top portion, and the top portion completely covers the second hollow region such that in the open position, the top portion prevents any portion of the first product moving from the first hollow region into the second hollow region of the bottom portion from spilling outside of the container, and wherein the bottom portion includes a first thread configured to allow the top portion to be screwed onto and off of the bottom portion, a bottom thread for locking the top portion to the bottom portion, and a gap between the first and second threads for allowing the top portion to be spun relative to the bottom portion without locking into the bottom portion or unscrewing from the bottom portion.

* * * * *